US005394577A

United States Patent [19]

James et al.

[11] Patent Number: 5,394,577

[45] Date of Patent: Mar. 7, 1995

[54] THERAPEUTIC ANTI-DECUBITUS, LATERAL ROTATION MATTRESS

[76] Inventors: Ingrid B. James; Brian O. James, both of 324 Persimmon Rd., Walnut Creek, Calif. 94598

[21] Appl. No.: 38,110

[22] Filed: Mar. 29, 1993

[51] Int. Cl.[6] ..... A47C 27/10

[52] U.S. Cl. ..... 5/455; 5/481; 5/453

[58] Field of Search ..... 5/481, 453, 455, 456, 5/903, 464, 465

[56] References Cited

U.S. PATENT DOCUMENTS

| | | | |
|---|---|---|---|
| 2,638,608 | 5/1953 | Gurrigus | 5/903 |
| 3,477,071 | 11/1969 | Emerson | 5/456 |
| 3,485,240 | 12/1969 | Fountain | 5/456 |
| 3,775,781 | 12/1973 | Bruno et al. | 5/453 |
| 3,919,730 | 11/1975 | Regan | 5/456 |
| 4,697,290 | 10/1987 | Alklind | 5/455 |
| 4,788,730 | 12/1988 | Bexton | 5/455 |
| 4,947,500 | 8/1990 | Seiler | 5/455 |
| 5,115,527 | 5/1992 | Medley | 5/468 |

FOREIGN PATENT DOCUMENTS

| | | | |
|---|---|---|---|
| 406428 | 6/1923 | Germany | 5/455 |
| 3217981 | 11/1982 | Germany | 5/453 |
| 3716263 | 11/1988 | Germany | 5/455 |
| 2750 | of 1912 | United Kingdom | 5/468 |

*Primary Examiner*—Flemming Saether
*Attorney, Agent, or Firm*—Bauer & Schaffer

[57] ABSTRACT

A plurality of pairs of inflatable air cells disposed on opposite sides of a longitudinal axis are arranged along the length of a bed. Each of the air cells extends substantially transverse to the longitudinal axis and are supplied with air so that cells on alternate sides are inflated while simultaneously the cells on the other side are deflated. An upper layer of a resinous foam pad is provided on which the patient lies. The pad is provided with a groove along its longitudinal axis for comfort of the patient. The assembly is completed by a covering having an upper sheet member removably attached to a lower sheet member so that when soiled it may be easily removed.

8 Claims, 2 Drawing Sheets

THERAPEUTIC ANTI-DECUBITUS, LATERAL ROTATION MATTRESS

BACKGROUND OF THE INVENTION

The present invention relates to therapeutic, anti-decubitus, lateral rotation mattresses for the relief of pressure sores and the rehabilitation of tissues of bed-ridden patients.

A disadvantage of conventional mattresses lies in the fact that after relatively short periods of time, the patient becomes subject to bed sores and tissue degradation. This is particularly a problem when the patient cannot or may not, even for a short time, exercise. Local massage is a palliative measure and not really economical or effective with long term patients.

An attempt to overcome this problem had been to provide a pneumatic air mattress. A later attempt had been to provide a mattress by which the patient may be caused to turn periodically and thereby relieve stress on the body. One such mattress is shown in the European Patent Disclosure EU-AZ-83 104582 to Dr. Helmut Volkner which provided two non-communicating, laterally neighboring halves, each consisting of a number of communicating air chambers, running transversely to the longitudinal axis of the mattress, and which are inflated in sequential intervals by means of a conduit system connected to a set of air pumps.

Some patients require mattresses which extend the entire length of their bodies, while in other cases, the turning movement of the patient should be restricted to certain regions, for example, the region of the seat. It is sometimes also necessary to except or exempt a certain region of the patient's body from the lifting pressure exerted by the mattress air chambers. The prior mattress was not adapted to fully provide for these needs.

Another problem with the known devices is that the frequency of inflation and deflation of the chambers, together with the lack of patient body movement is often not sufficient to prevent skin breakdown.

It is, therefore, the object of the present invention to provide an improved therapeutic air mattress which overcomes the disadvantages and deficiencies of the prior art mattresses.

It is another object of the present invention to provide an improved therapeutic air mattress which has great flexibility in adapting to individual needs.

These objects, together with other objects and advantages, are set forth in the following disclosure of the present invention.

SUMMARY OF THE INVENTION

According to the present invention a therapeutic pneumatic mattress comprising a bottom layer of inflatable mattress sections and an upper layer of foamed resinous material. The inflatable mattress sections are independently formed on opposite sides of a longitudinal axis and consist of separate removable elongated members each extending substantially transverse to the longitudinal axis. The mattress members are pneumatically connected to means selectively supplying air under pressure to the mattress sections on one side of the longitudinal axis simultaneously withdrawing air from the mattress on the other side. Preferably, fasteners are arranged on the marginal flanges of the individual mattress sections to removably join them to each other to maintain the integrity of the mattress.

The upper layer comprises a pad of foamed resin, overall, coextensive with the lower layer, and provided with a V-shaped groove on its upper surface along the longitudinal surface. The entire assembly is preferably covered by a fabric bag.

Full details of the present invention are set forth in the following description of the preferred embodiment, and are illustrated in the accompanying drawings.

DESCRIPTION OF THE INVENTION

Figure 1:
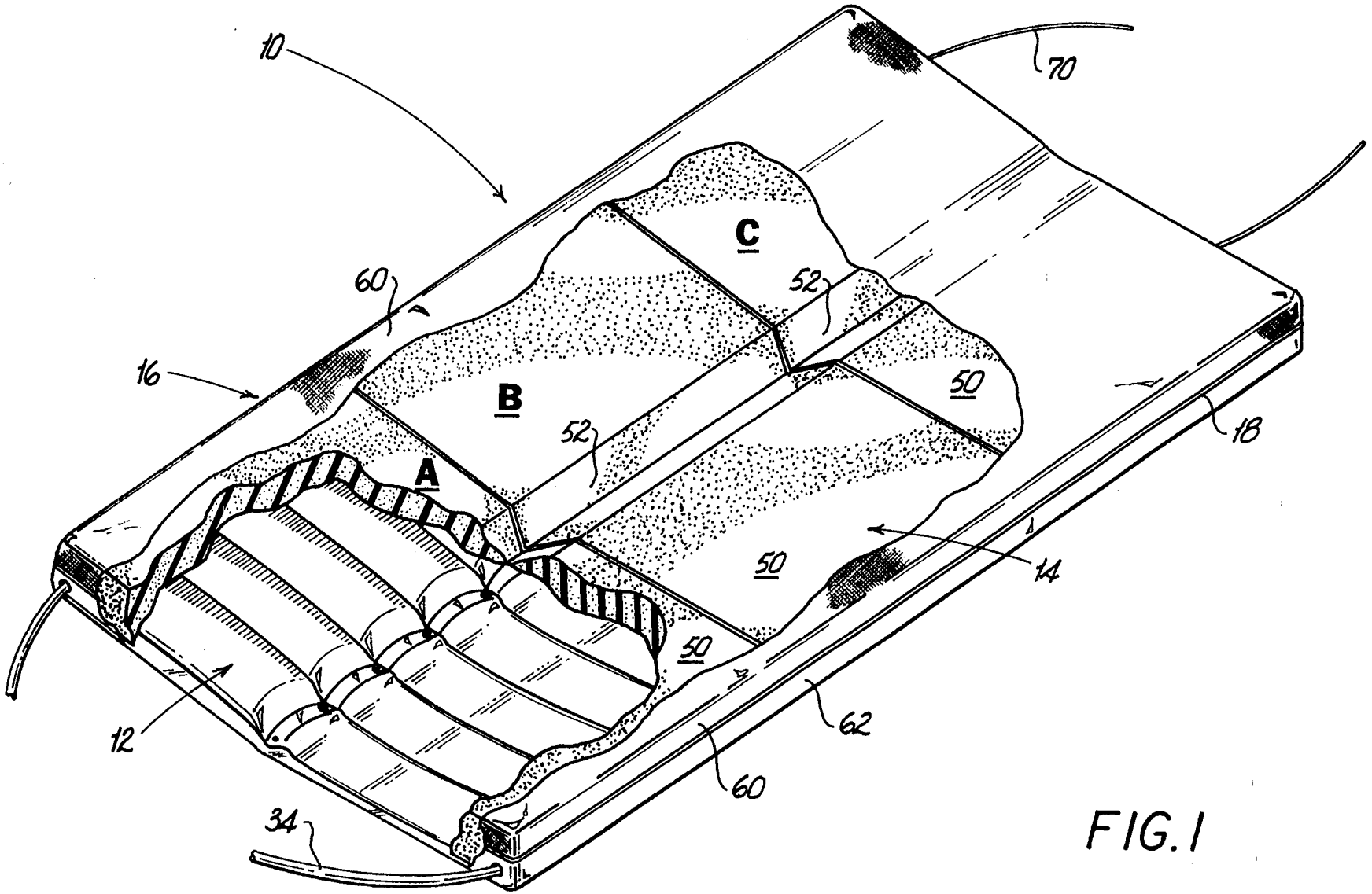
FIG. 1 is an isometric perspective view of the mattress assembly of the present invention, partially broken to show the air mattress and foam layers.

Turning first to FIG. 1, the air mattress of the present invention, generally depicted by the numeral 10, comprises a bottom air layer 12, an upper foam layer 14 and an enclosure in the form of a fabric bag 16 having a zipper 18 along one side.

Figure 2:
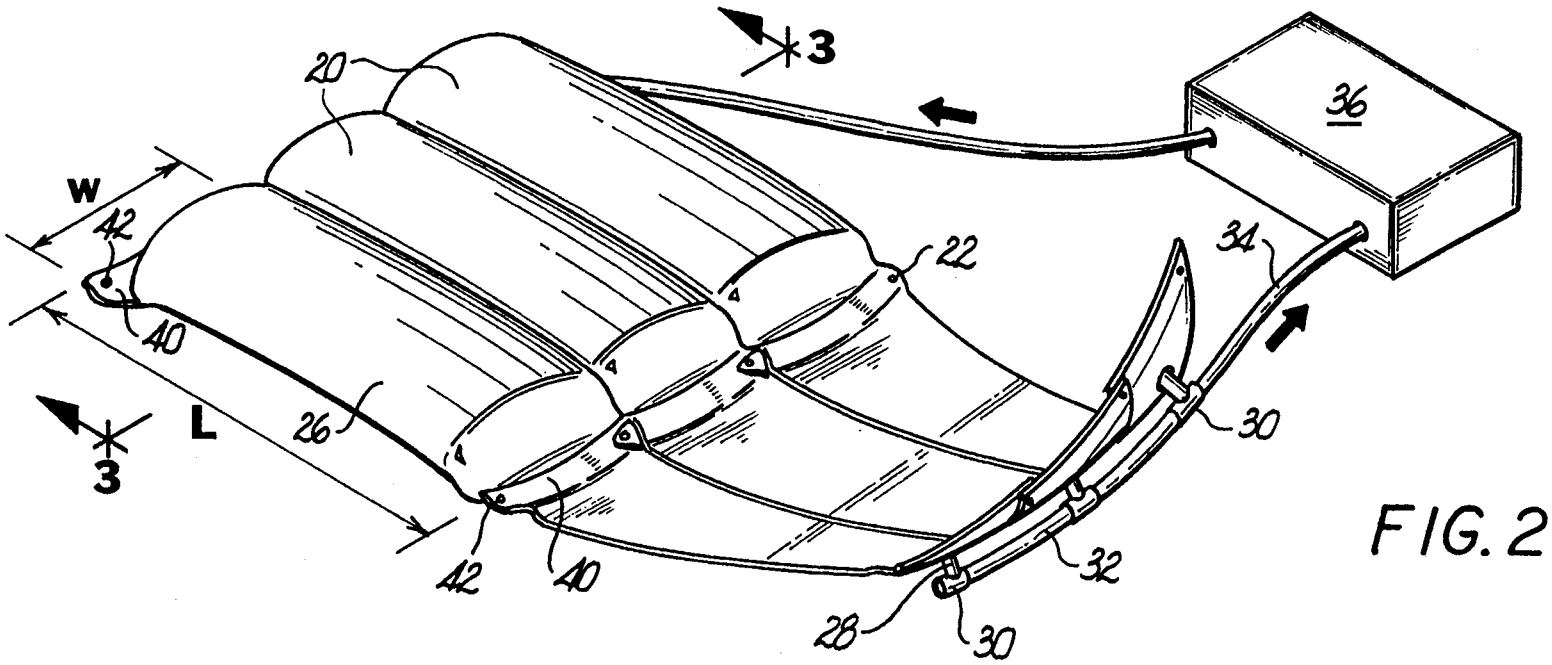
FIG. 2 is a schematic perspective of the air mattress and system for its inflation.
Figure 3:
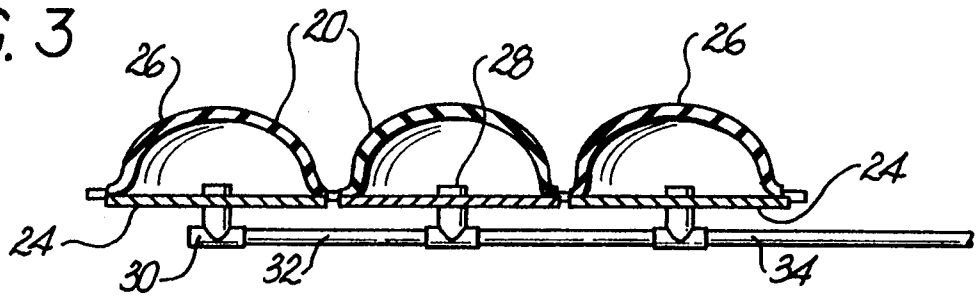
FIG. 3 is a sectional view of the air mattress shown in FIG. 2 taken along line 3—3.

The air layer 12, as seen in FIGS. 2 and 3, comprises a plurality of mattress sections 20 consisting of an inflatable cell. The sections 20 are arranged in tandem adjacent each other on opposing lateral sides of a central connecting strip 22 with the long axis of each individual mattress cell substantially transverse to this longitudinal axis of the mattress.

The mattress sections 20 are substantially identical to each other, and standardized so as to be readily interchangeable one with the other. Each section 20, as seen in FIG. 3, comprises a general planar, non-elastic base 24 to which is integrally attached a distendible or stretchable semi-cylindrical balloon-like cover 26. The cover 26 is sealed about its edge to the base 24 so that it defines with it the internal inflatable air cell that assumes a distended cylindrical configuration when filled with air but which lies substantially flat when not filled with air.

Each mattress section 20 is provided at its free end with an inlet/outlet port 28 so that each may be attached to a source of air by means of T-fitting 30, the stem of which is secured in the inlet/outlet port. Short pieces of hose 32 join the arms of the T-fittings to one another in series, while long pieces of flexible conduits 34 lead from the leading mattress section to a control device and source of air 36, such as a pump.

The individual mattress sections 20 are provided with laterally extending marginal flanges 40 provided with both male and female fastener element 42 arranged so that adjacent lying mattress sections 20 may be joined side by side and end to end. The number of mattress sections connected to each other determines the total length of the mattress which as seen in FIG. 1 define two rows, right and left, from the head end to the foot end, separated by the flat connecting strip 40.

In cases in which the mattress is to be used to support the entire body, a corresponding number of sections 20 are provided to support the patient completely while in those cases in which only a small region, e.g. the patient's seat, is to be supported, only a few elements may be provided. Generally, it will be preferable to provide a mattress somewhat shorter than the patient so that the patient's feet, particularly heels, extend beyond the mattress thereby avoiding sores on the heels of the foot.

In those instances where a portion of the body is to be exempt from support, one or more mattress sections on either side may be omitted between its end sections.

It has been found that cells of approximately 6–8 inches in the length L and about 24 inches in the width are effective. In this manner, a mattress using 12–15mattress sections 20 along each side can be easily constructed for accommodating the full length of conventional hospital beds.

The upper layer 14, as seen in FIG. 1, comprises a rectangular pad 50 preferably of an elastomeric foamed resin having a V-shaped groove 52 extending downwardly from its upper surface toward the central longitudinal axis.

Preferably, the upper layer is made in three pad sections, A, B and C, which, end to end, form the length of the mattress. The total length can thus be adjusted to accommodate small adults or children by removing a section of the foam layer (adjustment of the inflatable air sections will be correspondingly made). An effective foam layer which is about eight (8) inches shorter than a conventional hospital bed mattress permits the patient's heels to freely extend beyond the foam to again prevent sores on the heels or ankles. This shortening of the foam pad may be made in conjunction with a shortening of the inflatable air layer sections as discussed earlier.

A foam pad of approximately 2–3 inches is desirable. Each of the pad sections can be about 30 by 40 inches in length.

The V-groove 52, in addition to providing an air space directly beneath the patient, facilitates the actual movement of the foam pads 50 under the alternative stimulus of the left to right (and reverse) movement of the inflatable air sections. The groove avoids bunching and crimping of the foam material along the longitudinal axis. It also permits the mattress to be more easily folded for storage.

If desired, each side of the foam pad, that is the right and left portions of the foam pad relative to the central axis, may be made separately so as to part along the central longitudinal axis. They may be glued or otherwise held together prior to or during use while still enabling a smaller package for shipment and storage to be made.

The outer covering or bag 16 is formed of an upper sheet member 60 and a lower sheet member 62 each having a planar base section conforming substantially to the size of the mattress as a whole and being surrounded by a depending or upstanding skirt 64 to which one run of a continuous zipper 18 is attached. In this way, the upper sheet member 60 can be made of a fabric which is comfortable to the patient, bacteriostatic, fluid-proof, and nonstaining such as moleskin, flannel and the like. The lower sheet member, on the other hand, can be made from a strong waterproof material which may be wiped clean. In this manner, the upper sheet section 60 may be replaced completely when soiled or otherwise desired without fully dismantling the mattress and a clean sheet attached to the remaining lower sheet member.

The cover or bag 16 is desirably provided with tie-backs 70 which allow the mattress to be secured to the bedpost preventing the mattress from moving while the patient is lying on it. Also, the bag 16 is provided with holes or apertures allowing the air conduits 34 to pass from the inflatable sections to the control device 36.

The control device 36 is preferably provided not only with an integral air pump, but with automatic operable means for actuating the pump and with bi-directional valves so that air may be fed and removed from the air cells 20 at a selected periodicity. The control means may be mechanical and/or computer controlled.

The air for the inflatable sections need not be under high pressure since air mattresses can be filled and function effectively under low pressure. Therefore, the pump may be small as it needs to provide high volume rather than high pressure.

In operation, each row of cells are alternately inflated and simultaneously deflated of air, whereby during inflation the row of cells on one side of the central access, the pressure in the other row is reduced. Thus, the patient lying on the mattress is rotated in accordance with the movement of the air to and from the cells relieving the regions of tissue normally subject to pressure. The V-groove has a width and depth of several inches so that a substantially significant air space is formed beneath the patient.

It will, of course, be appreciated that a relatively simple, lightweight and easily movable therapeutic mattress is obtained which may be easily controlled to manipulate the patient so that the patient may be regularly turned from side to side. Pressure is relieved, sores prevented and the rehabilitation of the patient hastened. The rolling or turning action avoids the need for periodic massage, frequent bathing and oil rubbing.

Various changes and modifications have been suggested herein and others will be obvious to those skilled in the art. Accordingly, the present disclosure is to be taken as illustrative only and not as limiting the invention.

What is claimed is:

1. An anti-decubitus, pneumatic mattress comprising a bottom assembly of a plurality of inflatable, rectangular mattress cells disposed in edge-to-edge relationship in two rows on opposite sides of a longitudinal axis, each of said mattress cells being formed of a non-elastic base and a semi-cylindrical, distendible cover sealed about its edge to the base defining an inflatable air chamber, each base being provided with means for removably attaching said cells in said edge-to-edge relationship and conduit means entering into said air chamber adjacent the unfastened edges of said cells, a top assembly comprising a foam pad overlying the entire extent of said bottom assembly, said foam pad having a single groove on its upper surface extending along the longitudinal axis in alignment with the space between the two rows of mattress cells, and means for alternately supplying air to each of the mattress cells in one of said two rows while simultaneously withdrawing air from each of the mattress cells in the other of said two rows.

2. The mattress according to claim 1, wherein said groove in said foamed pad is V-shaped.

3. The mattress according to claim 1, wherein said foam pad is formed in multiple sections of equal width and arranged on said bottom assembly along the length thereof.

4. The mattress according to claim 1, including a bag in which said bottom assembly and said top assembly are contained.

5. The mattress according to claim 4, wherein said bag is formed of an upper and a lower section each comprising a sheet having an extent corresponding to that of said mattress, peripheral walls perpendicular thereto and means for securing the walls of the upper section to the lower section.

6. The mattress according to claim 5, wherein the means for securing the walls comprises a continuous zipper.

7. The mattress according to claim 5, wherein the sheet of the upper bag section is made of waterproof, non-porous material.

8. The mattress according to claim 1, wherein the means for supplying air to said mattress cells comprises a source of air under low pressure and control means for automatically supplying said air, and removing said air from the alternate rows of mattress cells in a selected periodic sequence.

* * * * *